United States Patent [19]

Strobel

[11] 4,008,129

[45] Feb. 15, 1977

[54] INTERMEDIATE HEAD FOR COKE OVEN BATTERIES

[75] Inventor: Manfred Strobel, Recklinghausen, Germany

[73] Assignee: Firma Carl Still, Germany

[22] Filed: Feb. 24, 1975

[21] Appl. No.: 552,217

[52] U.S. Cl. ..... 202/268; 202/222; 202/270

[51] Int. Cl.[2] ..... C10B 29/04; C10B 45/00

[58] Field of Search ..... 202/113, 222, 266, 268, 202/270

[56] References Cited

UNITED STATES PATENTS

| | | | |
|---|---|---|---|
| 1,786,284 | 12/1930 | Bauer | 202/268 |
| 3,054,730 | 9/1962 | Willeke | 202/222 |

FOREIGN PATENTS OR APPLICATIONS

| | | | |
|---|---|---|---|
| 1,031,278 | 11/1956 | Germany | 202/270 |

*Primary Examiner*—Joseph Scovronek
*Assistant Examiner*—Bradley Garris
*Attorney, Agent, or Firm*—McGlew and Tuttle

[57] ABSTRACT

An intermediate coke oven head comprises spaced apart substantially parallel steel-concrete side walls with cross walls connected between the side walls and dividing the space therebetween into a plurality of individual compartments. An aeration and ventilation system is connected to the compartments and includes one air inlet from the exterior of the walls extending into each compartment adjacent the lower ends thereof and at least one air outlet connected into the top of the compartments.

7 Claims, 8 Drawing Figures

INTERMEDIATE HEAD FOR COKE OVEN BATTERIES

BACKGROUND OF THE INVENTION

1. Field of the Invention

This invention relates in general to the construction of coke ovens and in particular to the construction of a new and useful intermediate head for coke oven batteries made up of a plurality of individual compartments which are formed between adjacent H-shaped elements and which are connected by air passages adjacent the lower and top ends thereof to an aeration or ventilating system.

2. Description of the Prior Art

So-called heads are constructed adjacent the ends of coke oven batteries and the longitudinal anchors of the batteries are anchored thereon. Their purpose is to hold the batteries together during the heating up period as the dilatations appear and also to insure the necessary stability during service. In those instances where a plurality of batteries are aligned in a row the intermediate heads are constructed between batteries and have the same purpose. Such intermediate heads are made up of steel concrete elements which are structurally anchored in the foundation of the battery. They comprise double walls which are arranged in spaced parallel relationship and parallel to the oven chambers and they are usually sectioned into compartments by cross walls for stiffening. In the prior art slots are provided in the concrete walls through which air cooling enters into the interspace between the walls and the partitions and it escapes again at the upper end. However such slots are located so that hot air is taken in and the intermediate head cannot be prevented from becoming too hot with the result that in course of time the concrete looses its strength. As soon as some of the chambers of the battery must be repaired and the heating thereof must be stopped, contractions are caused and the intermediate head can no longer support the structure because of the burning out of the large parts of the concrete and the lessening of the strength of the walls thereby. This burning out is primarily due to an insufficient aeration.

SUMMARY OF THE INVENTION

In accordance with the invention there is provided an intermediate head construction for coke oven batteries which does not burn out and which is constructed to maintain its strength for the entire life of many years service so that the necessary support of the battery is not restricted to the heating up period.

In accordance with the invention there is provided an intermediate head for batteries which comprises a double wall of steel concrete extending parallel to the oven chambers and in which the space between the walls is sectioned by cross walls into compartments which are individually connected to an aeration and ventilating system. The construction is characterized by an arrangement in which each compartment is provided adjacent its lower end with one or more fresh air inlets which takes air in from the outside and is connected at its upper end to an air outlet. The fresh air inlets and the air outlets may have a rounded or angular cross section and they may take the form of inserted steel tubes having diameters of from 30 to 60 cm. The fresh air inlets are advantageously located in the front portion of the heads, for example above the bench gallery.

The fresh air inlets are disposed one above the other and so that the lowermost ones establish connection with the compartments in the middle of a row of compartments and the upper ones connect to the outer compartments.

The air outlets are advantageously provided in the upper horizontal girder which connects into the compartments and they may at the same time serve as anchor bars for the fastening of the longitudinal anchors of the battery.

With the inventive construction any overheating of the steel concrete members even in the interior is prevented and no high temperatures will occur which are greater than 350° C, the temperature which can be easily sustained by a steel concrete member without any time limitation.

The main load of the intermediate head appears at the level of the floor of the oven chambers. That is why the double wall is provided with a thickened area in this zone through which the reinforcing steel or steel anchor elements are passed. The inventive head may be designed so that the air slots in the inner walls at both sides of the intermediate head may also be supplied with fresh air. For this purpose passages from the head to the air slots of the liner walls are provided at the level of the oven floor and at the upper end of the head. The cooling air for the liner walls enters through the fresh air inlets of the battery head and passes through the passages into the air slots of the liner walls and is there guided upwardly to escape through openings provided in the roof.

For modern coke oven batteries having a width of from 15 to 17 meters and a height of from 5 to 8 meters of the oven chambers, a sectioning of the double wall into six compartments has proved very satisfactory.

In a particularly advantageous and time-saving manner the inventive intermediate head may be constructed of prefabricated concrete reinforced parts. In such a case it is assembled of prefabricated parts having H and U shaped cross sections and provided with openings for fresh air inlets for the passage of fresh air into the air slots of the liner walls. They also provide it with a thickened or reinforced portion at the level of the oven floors which have holes for receiving longitudinally extending tie rods. They also include extensions for the structural anchoring in the battery foundation and for the mounting of the bench gallery and they comprise an upper horizontal girder formed with a plurality of rectangular or rounded openings for the air escape which correspond in number to the number of compartments.

For the construction of an intermediate head having six compartments, five prefabricated parts having an H-shaped cross section and two prefabricated parts having U-shaped cross sections are needed. They are anchored in the foundation of the battery and connected at their upper ends to the horizontal girder. The tubes which serve as anchor bars for the fastening of the longitudinal anchors of the battery may be inserted into the openings provided in the upper horizontal girder.

Tie stirrups and longitudinal irons with which the individual prefabricated parts are connected to each other are embedded in the mutually opposite surfaces of the prefabricated parts. Thus none of the parts will move and a firm connection with the support is established.

The holes of the thickened areas at the floor level may also receive tubes which accommodate the tie rods and the tubes of adjacent parts may be connected to each other by connecting sleeves. Upon the passing through of the tie rods the tubes may be filled with a mortar. The connection spaces between the individual prefabricated parts may also be filled up. Advantageously this filling is with concrete.

The construction time of a battery head made of prefabricated parts in accordance with the invention is from two to three weeks while 4 to 6 weeks are needed for a construction of the conventional type.

Accordingly it is an object of the invention to provide an improved intermediate coke oven head which is made up of spaced parallel steel-concrete walls defining an interspace therebetween which is subdivided into individual compartments by cross walls which extend between the side walls wherein the side walls are provided with air inlets adjacent the lower ends which communicate with each respective compartment and the exterior and are connected adjacent their upper ends to air outlets.

A further object of the invention is to provide a coke oven intermediate head which is made up of a plurality of H-shaped prefabricated elements arranged with adjacent legs of the H-shaped ends in end-to-end relationship so as to define a plurality of intermediate compartments between adjacent prefabricated parts with a U-shaped element arranged at each end of the outermost H-shaped element to close off a further compartment at each end thereof, said H-shaped elements and said U-shaped elements having passages defined therethrough adjacent the lower end which communicate successively with each compartment and the exterior of said intermediate coke oven head, and including a girder disposed over the top of said elements having openings therein for the passage of air.

A further object of the invention is to provide an intermediate coke oven head and a prefabricated element for forming such head which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENT

Figure 1:
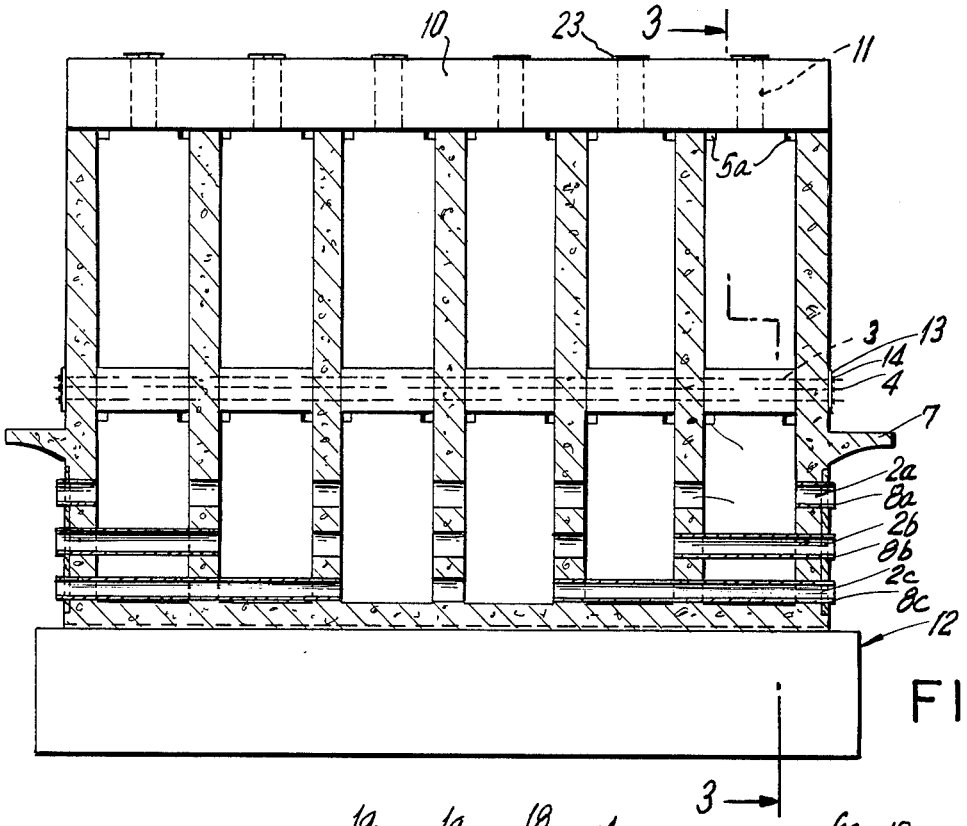
FIG. 1 is a side elevational view of an intermediate coke oven head constructed in accordance with the invention.
Figure 2:
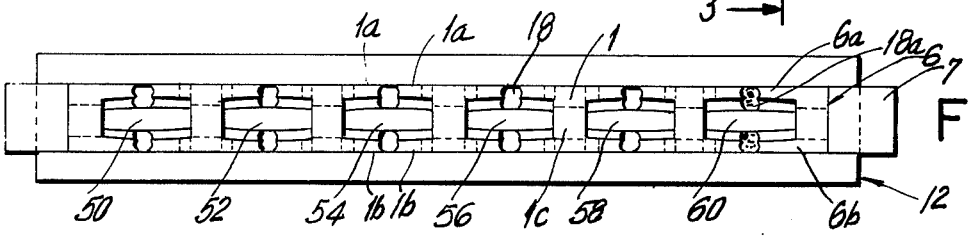
FIG. 2 is a top plan view of the head shown in FIG. 1 but with the girder removed.

Referring to the drawings in particular the invention embodied therein comprises an intermediate coke oven head which is made up of a plurality of H-shaped vertically elongated steel concrete parts or reinforced concrete parts 1 which are arranged in end-to-end relationship with leg portions 1*a*, 1*a* and 1*b*, 1*b* of adjacent elements or units arranged in end to end relationship. Web portions 1*c* of each H-shaped member 1 define cross walls which extend between parallel side walls formed by the legs 1*a*, 1*b*. Each H-shaped member includes connecting stirrup 19 at each leg portion 1*a* and 1*b* so that they may be interconnected and the space 18 between adjacent H-shaped units are filled with mortar after the parts have been interconnected.

In addition to the H-shaped members each end of the intermediate wall is closed by a U-shaped element 6 having leg portions 6*a* and 6*b* which are arranged in end-to-end relationship with the leg portions 1*a* and 1*b* of the outermost H-shaped member 1. The space 18*a* between the leg portions 6*a*, 1*a* and 6*b*, 1*b* are filled with mortar.

In accordance with a feature of the construction an aeration and ventilating system is connected into each compartment 50, 52, 54, 56, 58 and 60 which are formed by the units 1 and 6. For this purpose each member 6 and member 1 are provided with air inlets 2 at spaced locations along their height adjacent the lower ends thereof. In addition reinforcing rod members or anchors 4 are inserted into tubes 3 which extend through widened areas or thickenings 20 of the associated members 1 and 6. In addition they are provided with upper air passages 5 and 5*a*.

The end parts 6 are formed with brackets 7 for mounting of platforms and with the air inlets 2*a*, 2*b* and 2*c*. These air inlets receive tubes 8*a*, 8*b* and 8*c*.

Each unit 1 is mounted in a foundation 12 by an anchoring element 9. An upper horizontal girder 10 extends over all of the units and it is provided with outlet tubes 11. Anchors 4 are tightened and retained by means of a plate 13 and nuts 14 as shown particularly in FIG. 7. Liner walls 15 extend between the intermediate heads in the oven chambers 16 and the reinforcement anchors 4 are located at about the level of the floors of the oven 16. Slots 17 for air are provided in the oven chambers 16.

Figure 3:
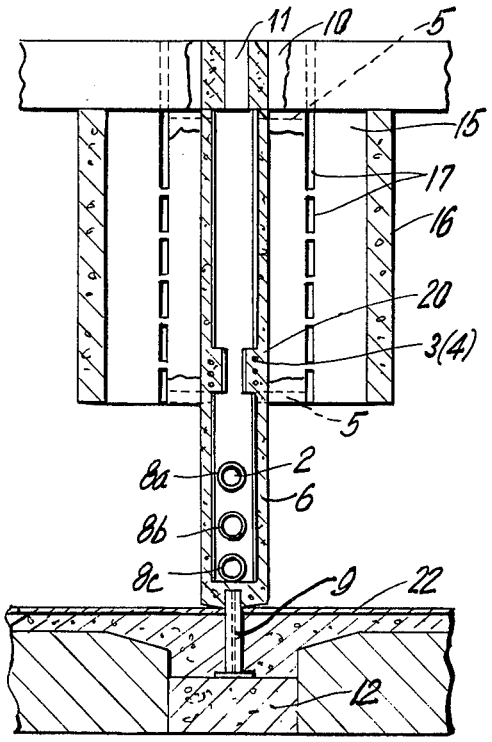
FIG. 3 is a partial end elevational view of the intermediate head construction shown in FIG. 1.
Figure 4:
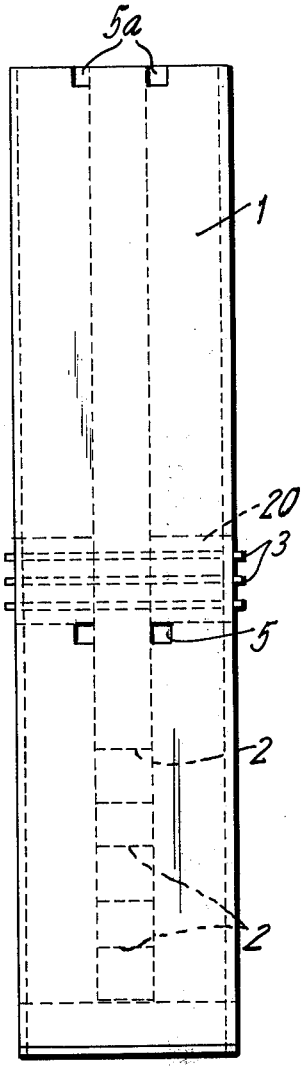
FIG. 4 is an enlarged elevational view of one of the prefabricated units employed for forming the head.
Figure 6:
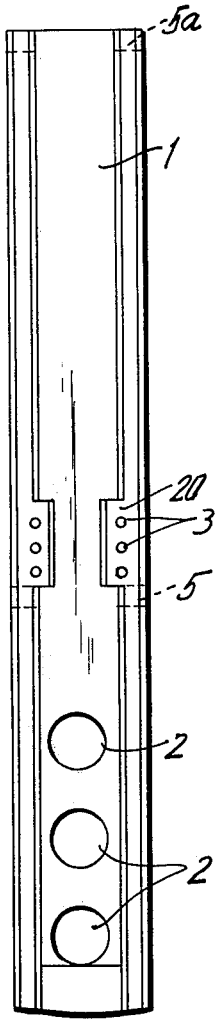
FIG. 6 is an end elevational view of the unit shown in FIG. 4.
Figure 5:
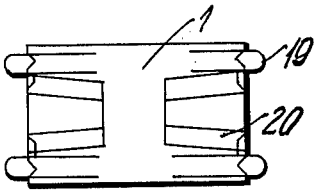
FIG. 5 is a top plan view of the unit shown in FIG. 4.
Figure 7:
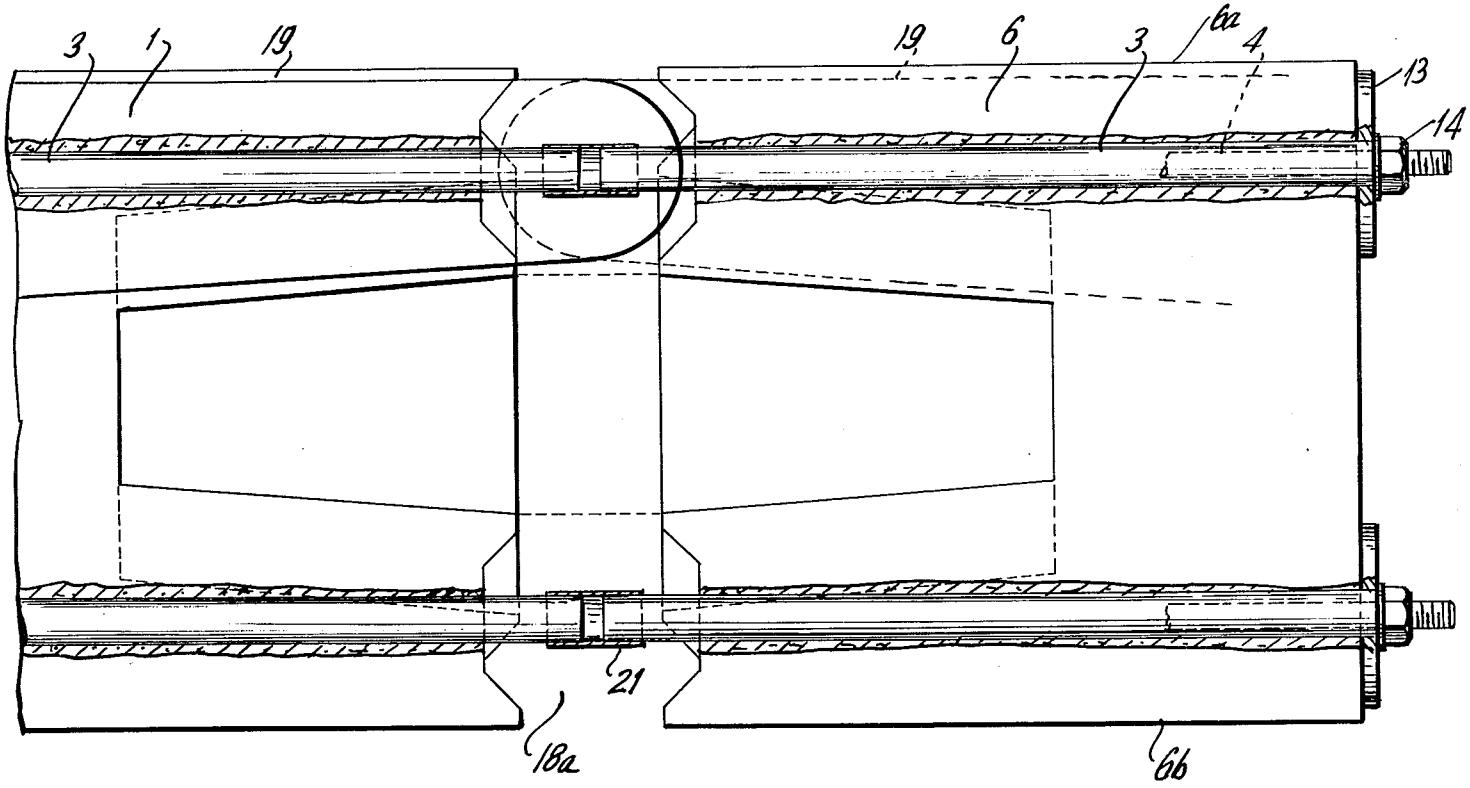
FIG. 7 is an enlarged partial top plan view similar to FIG. 2.
Figure 8:
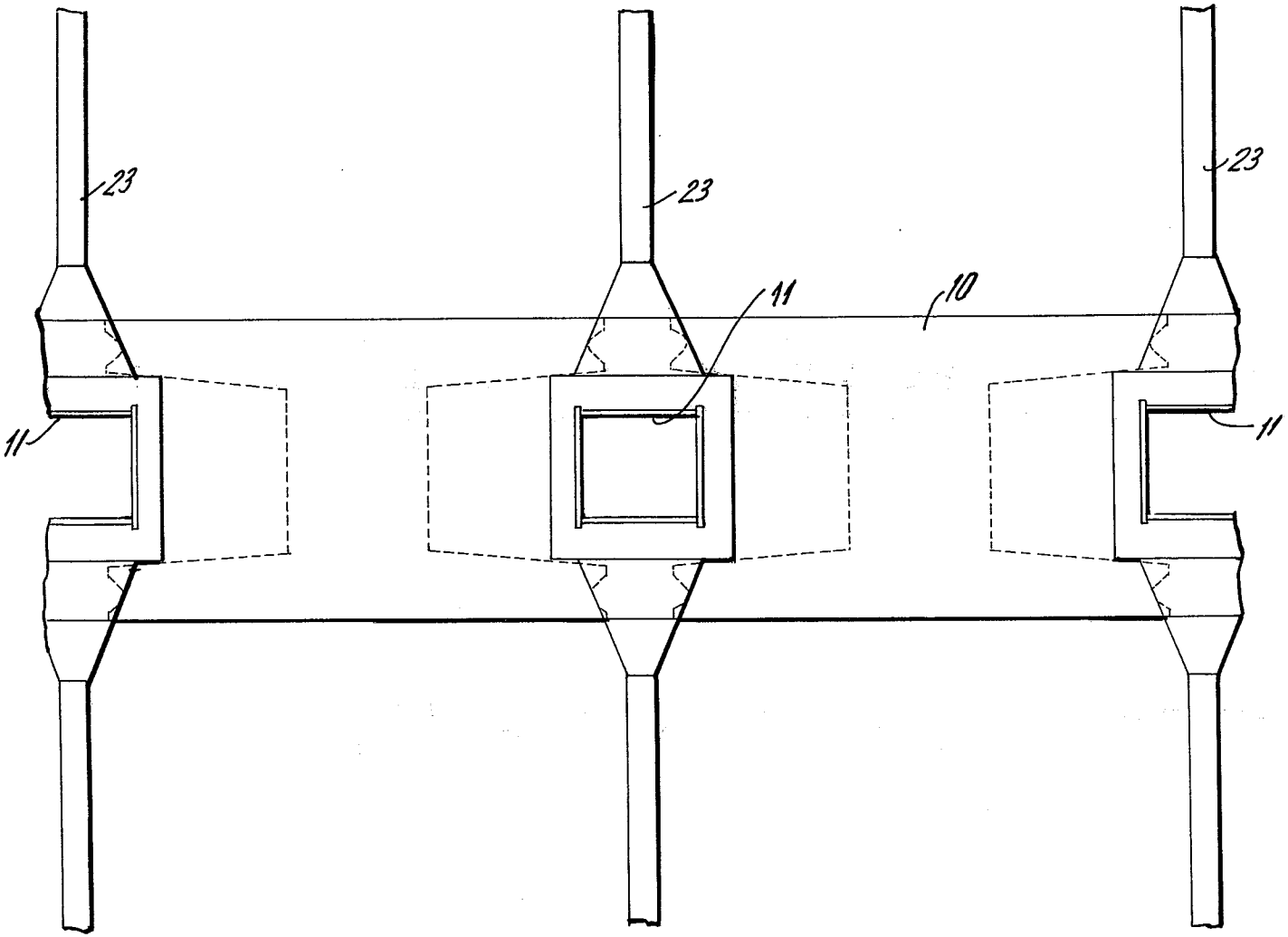
FIG. 8 is an enlarged partial top plan view showing the girder.

The tie stirrups which are provided to secure the elements 1 together are shown only at one side in FIG. 7. Tubes 3 are connected by sleeves 21 as shown in FIG. 7 in order to permit a filling with mortar. As soon as the mounting is terminated the connection spaces 18 and 18*a* are filled with concrete. A cover plate 22 is provided over the foundation 12 as shown in FIG. 3. Longitudinal anchors 23 of the battery are fastened to the air outlet tubes 11 as shown in FIG. 8.

While a specific embodiment of the invention has been shown and described in detail to illustrate the application of the principles of the invention, it will be understood that the invention may be embodied otherwise without departing from such principles.

What is claimed is:

1. In an intermediate coke oven head comprising spaced-apart substantially parallel steel concrete side walls, cross walls between said side walls dividing the space between said side walls into a plurality of individual compartments, the improvement comprising an aeration and ventilation system connected to said compartments comprising a plurality of air inlets arranged vertically at distinct levels one above the other and extending inwardly from each end of said intermediate head with the lowermost of said air inlets being connected to the innermost of said compartments and with successively higher inlets being connected respectively to the next successively adjacent outer compartment, and at least one air outlet connected to the top of said compartments.

2. An intermediate coke oven head comprising spaced-apart substantially parallel steel concrete side walls, cross walls between said side walls dividing the space between said side walls into individual compartments, and an aeration and ventilation system connected to said compartments including lowermost conduits forming air inlets extending from each respective end of said head to the two central compartments therein and additional conduits forming additional inlets extending from each end of said head into each respective next-successively adjacent outer compartment, said inlets being located adjacent the lower ends of the respective compartments, and at least one air outlet connected to the top of each of said compartments.

3. An intermediate coke oven head according to claim 2, wherein said air inlets have a diameter of from 30 to 60 cm.

4. An intermediate coke oven head according to claim 2, wherein said head is divided into at least six compartments.

5. An intermediate coke oven head according to claim 2, including a horizontal girder extending over the tops of said walls and having openings extending into each of said compartments and constituting said air outlets.

6. An intermediate coke oven head according to claim 2, wherein said spaced apart substantially parallel side walls and cross walls are formed by a plurality of individual substantially H-shaped members arranged with leg portions in end-to-end relationship and a U-shaped element at each end having leg portions arranged in end-to-end relationship with the leg portions of said H-shaped members each having openings for fresh air inlets and each having reinforced areas with reinforcing rods extending therethrough.

7. An intermediate coke oven head according to claim 6, including bench gallery mounting brackets carried on each end of said intermediate coke oven head, an upper horizontal girder extending across said intermediate head and wherein said at least one air outlet comprises a plurality of tubes extending downwardly into said compartments.

* * * * *